US005819482A

United States Patent [19]

Belke et al.

[11] Patent Number: 5,819,482

[45] Date of Patent: Oct. 13, 1998

[54] STRUCTURAL SUPPORT COLUMN WITH A TELESCOPICALLY ADJUSTABLE HEAD

[75] Inventors: Robert Theodore Belke; Stephen Wright, both of Edmonton, Canada

[73] Assignee: D.F. Foreman Enterprises Ltd., Alberta, Canada

[21] Appl. No.: 915,647

[22] Filed: Aug. 21, 1997

[30] Foreign Application Priority Data

Aug. 27, 1986 [CA] Canada ..... 2184241

[51] Int. Cl.[6] ..... E04B 9/00

[52] U.S. Cl. ..... 52/126.6; 52/126.3; 248/354.3

[58] Field of Search ..... 52/126.6, 126.7, 52/126.3, 126.5, 736.1; 248/354.3

[56] References Cited

U.S. PATENT DOCUMENTS 3,222,030 12/1965 Thorpe ..... 52/126.6 X 4,870,789 10/1989 Clark et al. ..... 52/126.6

*Primary Examiner*—Creighton Smith

*Attorney, Agent, or Firm*—Anthony R. Lambert

[57] ABSTRACT

A structural support column with telescopically adjustable head, includes a base, and an elongate support member extending substantially vertically from the base. The support member has a remote end opposed to the base with a cavity. A centralizing member covers the cavity at the remote end of the support member. The centralizing member has an aperture which is axially aligned with the longitudinal axis of the support member. A levelling screw is provides having a first end with a head and a second end. The second end of the levelling screw extends through the aperture in the centralizing member and is secured against removal by a levelling nut. The first end of the levelling screw is received in the rectangular cavity at the remote end of the support member. The head at the first end of the levelling screw is received in close fitting engagement in the cavity. A support bracket is positioned at the second end of the levelling screw.

5 Claims, 3 Drawing Sheets

STRUCTURAL SUPPORT COLUMN WITH A TELESCOPICALLY ADJUSTABLE HEAD

FIELD OF THE INVENTION

The present invention relates to a structural support column with a telescopically adjustable head.

BACKGROUND OF THE INVENTION

Structural support columns are generally equipped with a telescopically adjustable head that allows adjustments in length of up to 4 inches (100 mm). Adjustment of the telescopically adjustable head is accomplished using levelling screws. This adjustable head tends to reduce the load-carrying capacity of the structural support column by at least 10%, as failure occurs due to buckling of the levelling screws on the adjustable head before failure due to overall buckling of the support column.

U.S. Pat. No. 4,870,789 and U.S. Pat. No. 5,056,750 are representative of structural support columns having telescopically adjustable heads. U.S. Pat. No. 4,870,789 entitled "Manufactured Building Adjustable Levelling and Support Device" issued to Clark et al in 1989. The Clark et al reference discloses a structural support column which includes a support bracket attached to the head of a levelling screw. The levelling screw is received in a top plate on a vertical column. The top plate has a depending levelling screw stabilizing collar. A levelling nut is positioned on the levelling screw, and bears against the top plate as a means of height adjustment. U.S. Pat. No. 5,056,750 entitled "Support Column" issued to Ellithorpe in 1991. The Ellithorpe reference discloses a support bracket attached to an unthreaded telescopic member and a pair of levelling screws spaced on opposed sides of the telescopic member. The unthreaded telescopic member is insertable into a top of a vertical column. The top of the vertical column also requires one of a variety of alternate embodiments of support bracket. The levelling screws extend through apertures in the support bracket. Levelling nuts are positioned on the levelling screws, and bear against the support brackets as a means of height adjustment.

SUMMARY OF THE INVENTION

What is required is a structural support column with a telescopically adjustable head that will be less prone to failure due to buckling of its levelling screws.

According to the present invention there is provided a structural support column with telescopically adjustable head, which includes a base, and an elongate support member extending substantially vertically from the base. The support member has a remote end opposed to the base with a cavity. A centralizing member covers the cavity at the remote end of the support member. The centralizing member has an aperture which is axially aligned with the longitudinal axis of the support member. A levelling screw is provides having a first end with a head and a second end. The second end of the levelling screw extends through the aperture in the centralizing member and is secured against removal by a levelling nut. The first end of the levelling screw is received in the rectangular cavity at the remote end of the support member. The head at the first end of the levelling screw is received in close fitting engagement in the cavity. A support bracket is positioned at the second end of the levelling screw.

With the structural support column, as described above, the levelling screw is supported in two places. It is supported at the first end by the close fitting engagement between the head and the cavity. It is also supported at an intermediate position between first end and second end by the centralizing member. With such dual support being provided, the structural support column is less prone to failure due to buckling of its levelling screws.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 2:
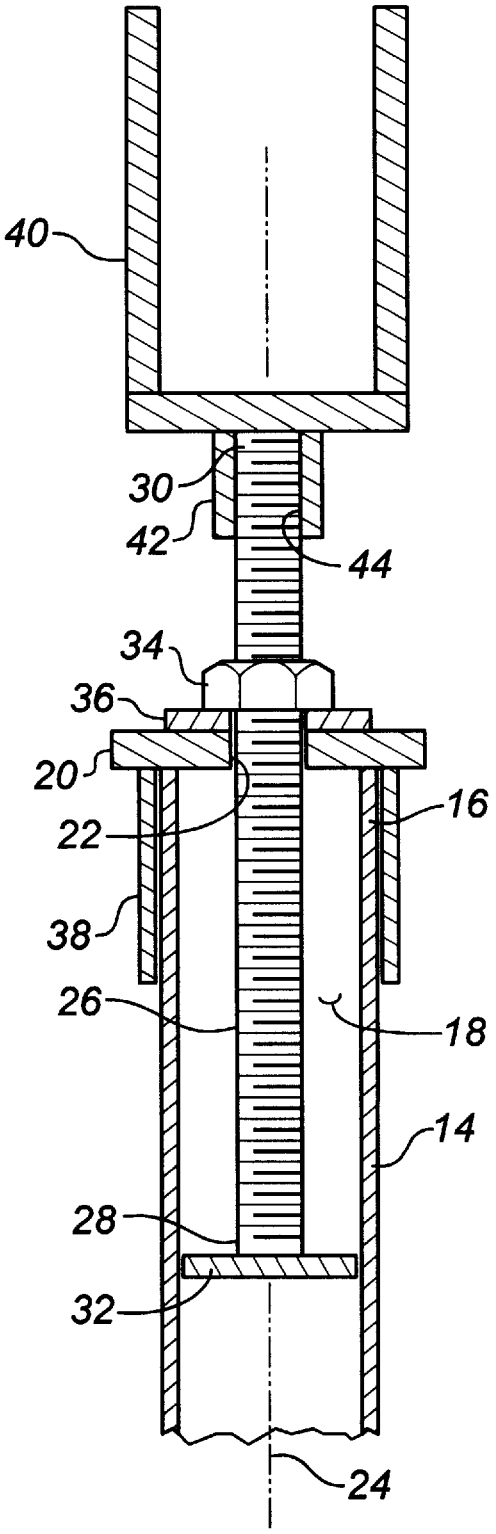
FIG. 2 is an end elevation view, in section, of the structural support column illustrated in FIG. 1.
Figure 3:
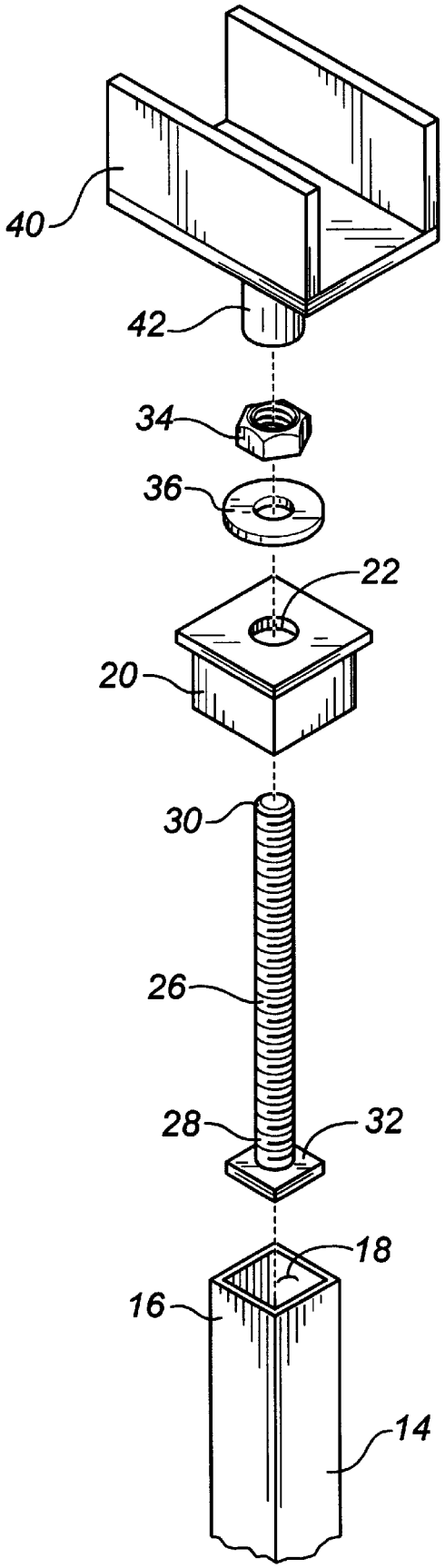
FIG. 3 is an exploded perspective view of the structural support column illustrated in FIG. 1.

The preferred embodiment, a structural support column generally identified by reference numeral 10, will now be described with reference to FIGS. 1 through 3.

Figure 1:
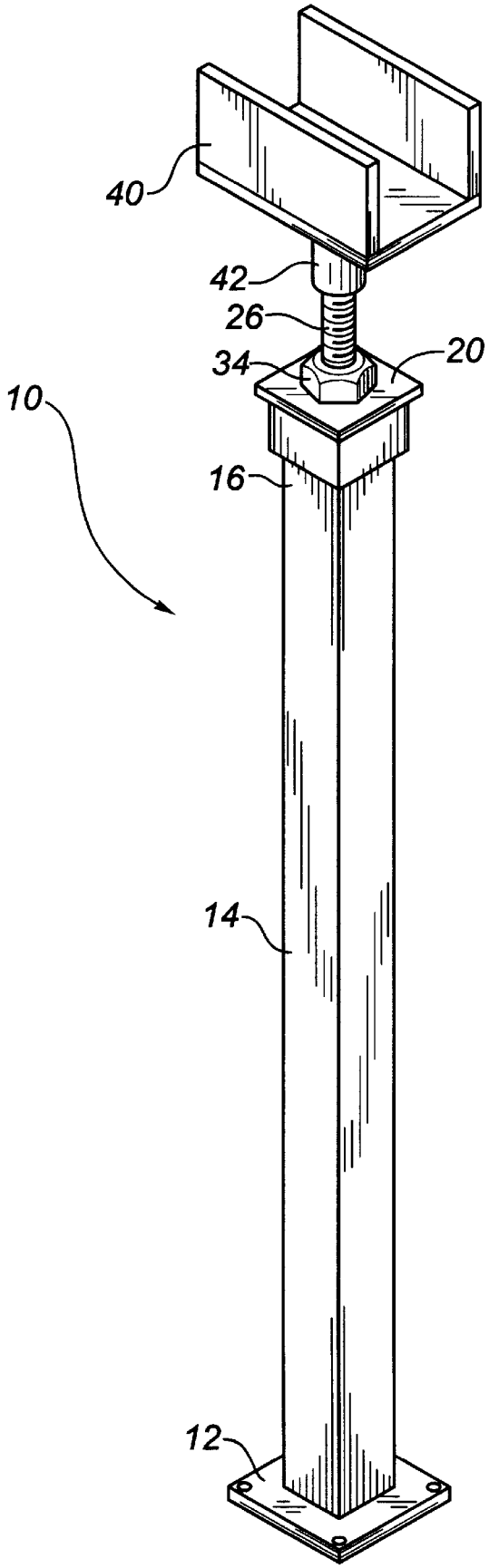
FIG. 1 is a perspective view of a structural support column constructed in accordance with the teachings of the present invention.

Referring to FIG. 1, structural support column 10 includes a base 12, and an elongate support member 14 extending substantially vertically from base 12. Support member 14 has a remote end 16 opposed to base 12. Referring to FIG. 3, remote end 16 has a rectangular cavity 18. Referring to FIG. 2, a close fitting centralizing cap 20 is positioned at remote end 16 of support member 14. Referring to FIG. 3, centralizing cap 20 has an aperture 22. Referring to FIG. 2, aperture 22 provides access to rectangular cavity 18 and is axially aligned with a longitudinal axis 24 of support member 14. Referring to FIG. 3, a levelling screw 26 is provided having a first end 28 and a second end 30. A rectangular head 32 is positioned at first end 28. Referring to FIG. 2, second end 30 of levelling screw 26 extends through aperture 22 in centralizing cap 20 and is secured against removal by a levelling nut 34. First end 28 of levelling screw 26 is received in rectangular cavity 18 at remote end 16 of support member 14. Rectangular head 32 at first end 28 of levelling screw 26 is received in close fitting engagement in rectangular cavity 18. Referring to FIG. 3, it is preferred that a washer 36 be positioned between levelling nut 34 and centralizing cap 20. Referring to FIG. 2, centralizing cap 20 has a depending skirt 38 that assists in preventing centralizing cap from being laterally displaced. Referring to FIG. 3, a support bracket 40 is provided having a depending collar 42. Referring to FIG. 2, depending collar 42 has a aperture 44. Aperture 44 receives second end 30 of levelling screw 26. If desired, aperture 44 may be threaded.

It is anticipated that the head of the levelling screw and the cavity into which it is received in close fitting engagement will be rectangular, preferably square. It is possible, however, to manufacture a workable embodiment of the invention utilizing different geometric shapes; such as a circular head in a circular cavity or a hexagonal head in a hexagonal cavity. It is also possible to have the head and the cavity of differing shapes as long as they are capable of mating in close fitting relation. For example, an "X" shaped head can fit in close fitting relation within a square cavity. It is anticipated that the support member will be tubular, however, it is possible to manufacture a support member out of solid bar stock and machine the necessary cavity in the remote end into which the head of the levelling screw is received.

The close fitting engagement between the head of the levelling screw and the cavity at the remote end of the support member provides a secondary benefit. With prior art devices there was a tendency for the levelling screw and, consequently, the support bracket to rotate as the levelling nut was tightened. With structural support column 10, levelling screw 26 cannot rotate as head 32 is non-rotatably fixed within cavity 18 of support member 14.

Experience and independent testing have demonstrated that the success of the present invention increases as the quality of fabrication improves. Care should be taken to avoid manufacturing imperfections in securing head 32 onto levelling screw 26 and in machining head 26 to close tolerances to fit within cavity 18. Head 32 should be perpendicular to levelling screw 26. When head 32 is secured at an angle, unequal load distribution can result in failure at head 32. Head 32 should fit as closely as possible within cavity 18 without sticking. The objective is to provide no room for movement of levelling screw 26, so that it is impossible for buckling to occur.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A structural support column with telescopically adjustable head, comprising:

a base;

an elongate support member extending substantially vertically from the base and having a remote end opposed to the base with a cavity;

a centralizing member covering the cavity at the remote end of the support member, the centralizing member having an aperture which is axially aligned with a longitudinal axis of the support member;

a levelling screw having a first end with a head and a second end, the second end of the levelling screw extending through the aperture in the centralizing member and being secured against removal by a levelling nut, the first end of the levelling screw being received in the cavity at the remote end of the support member, the head at the first end of the levelling screw being in close fitting engagement in the cavity; and a support bracket positioned at the second end of the levelling screw.

2. A structural support column with telescopically adjustable head, comprising:

a base;

an elongate support member extending substantially vertically from the base and having a remote end opposed to the base with a rectangular cavity;

a centralizing member covering the rectangular cavity at the remote end of the support member, the centralizing member having an aperture which is axially aligned with the longitudinal axis of the support member;

a levelling screw having a first end with a rectangular head and a second end, the second end of the levelling screw extending through the aperture in the centralizing member and being secured against removal by a levelling nut, the first end of the levelling screw being received in the rectangular cavity at the remote end of the support member, the rectangular head at the first end of the levelling screw being in close fitting engagement in the rectangular cavity; and a support bracket positioned at the second end of the levelling screw.

3. The structural support column as defined in claim 2, wherein the support bracket has a depending collar with an aperture which receives the second end of the levelling screw.

4. The structural support column as defined in claim 2, wherein the centralizing member is a close fitting cap.

5. A structural support column with telescopically adjustable head, comprising:

a base;

an elongate support member extending substantially vertically from the base and having a remote end opposed to the base with a rectangular cavity;

a close fitting centralizing cap positioned at the remote end of the support member, the centralizing cap having an aperture which provides access to the rectangular cavity and is axially aligned with the longitudinal axis of the support member;

a levelling screw having a first end with a rectangular head and a second end, the second end of the levelling screw extending through the aperture in the centralizing member and being secured against removal by a levelling nut, the first end of the levelling screw being received in the rectangular cavity at the remote end of the support member, the rectangular head at the first end of the levelling screw being in close fitting engagement in the rectangular cavity; and a support bracket having a depending collar with an aperture, the aperture receives the second end of the levelling screw.

* * * * *